US009016504B2

(12) United States Patent
McClung et al.

(10) Patent No.: US 9,016,504 B2
(45) Date of Patent: Apr. 28, 2015

(54) CAN END, DOUBLE ACTION TAB THEREFOR, TOOLING ASSEMBLY, AND ASSOCIATED METHOD

(75) Inventors: James A. McClung, Canton, OH (US); Aaron E. Carstens, Centerville, OH (US); Dennis C. Stammen, Brookville, OH (US); Gregory H. Butcher, Columbus, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

(21) Appl. No.: 13/554,438

(22) Filed: Jul. 20, 2012

(65) Prior Publication Data

US 2013/0037543 A1 Feb. 14, 2013

Related U.S. Application Data

(60) Provisional application No. 61/510,262, filed on Aug. 11, 2011.

(51) Int. Cl.
*B65D 17/34* (2006.01)
*B65D 17/00* (2006.01)

(52) U.S. Cl.
CPC ..... *B65D 17/165* (2013.01); *B65D 2517/0014* (2013.01); *B65D 2517/0062* (2013.01); *B65D 2517/0082* (2013.01); *B65D 2517/0094* (2013.01)

(58) Field of Classification Search
USPC ..... 220/269, 270, 271, 273, 231, 906, 272
See application file for complete search history.

(56) References Cited

U.S. PATENT DOCUMENTS

| | | | | |
|---|---|---|---|---|
| 3,307,737 | A * | 3/1967 | Harvey et al. | 220/271 |
| 3,477,608 | A | 11/1969 | Fraze | |
| 3,499,573 | A * | 3/1970 | Adams | 220/271 |
| 5,011,037 | A | 4/1991 | Moen et al. | |
| 5,307,947 | A | 5/1994 | Moen et al. | |
| 5,397,014 | A | 3/1995 | Aydt | |
| 5,695,085 | A | 12/1997 | Hadener | |

(Continued)

FOREIGN PATENT DOCUMENTS

| | | |
|---|---|---|
| EP | 2038178 | 10/2010 |
| WO | WO2010046516 | 4/2010 |

OTHER PUBLICATIONS

International Search Report and Written Opinion, PCT/US2012/047567, dated Oct. 15, 2012.

(Continued)

*Primary Examiner* — Jeffrey Allen
(74) *Attorney, Agent, or Firm* — Eckert Seamans Cherin & Mellott, LLC; Grant E. Coffield; John P. Powers

(57) ABSTRACT

A tab is provided for a can end. The can end includes an end panel and a scoreline defining a tear panel in the end panel for providing an opening in the can end. The tab includes a body having first and second opposing ends, a nose portion located at or about the first end, a lift portion located at or about the second end, and a rivet receiving portion disposed proximate the nose portion. The rivet receiving portion includes a rivet hole. A first rivet extends outwardly from the end panel and fastens the rivet receiving portion of the tab to the can end. A second rivet extends outwardly from the end panel to cooperate with a portion of the body proximate the lift portion.

15 Claims, 7 Drawing Sheets

(56) References Cited

U.S. PATENT DOCUMENTS

| | | | | |
|---|---|---|---|---|
| 5,819,973 | A * | 10/1998 | Traub et al. | 220/271 |
| 6,079,583 | A | 6/2000 | Chasteen | |
| 6,354,453 | B1 | 3/2002 | Chasteen | |
| 8,177,092 | B2 | 5/2012 | Mills | |
| 2008/0011786 | A1 | 1/2008 | Mathabel et al. | |
| 2008/0314906 | A1 | 12/2008 | Butcher et al. | |
| 2009/0050637 | A1 | 2/2009 | Shetty et al. | |
| 2009/0090716 | A1 | 4/2009 | Stengel, Jr. | |
| 2009/0095752 | A1 | 4/2009 | McEldowney et al. | |
| 2009/0179033 | A1 | 7/2009 | Ramsey et al. | |
| 2009/0200305 | A1 | 8/2009 | Stude | |
| 2010/0000997 | A1 | 1/2010 | Southers | |
| 2011/0000913 | A1 | 1/2011 | Bland | |
| 2011/0056945 | A1 | 3/2011 | Ramsey et al. | |

OTHER PUBLICATIONS

Rafael Perez Garcia, "Click Clack System Double Opening System for Beverage Can Ends", Mar. 24, 2009, pp. 1-39, Informative Dossier, Valencia.

Supplementary European Search Report Dated Feb. 12, 2015.

* cited by examiner

CAN END, DOUBLE ACTION TAB THEREFOR, TOOLING ASSEMBLY, AND ASSOCIATED METHOD

RELATED APPLICATION

This application claims the benefit of Provisional Application No. 61/510,262, filed on Aug. 11, 2011 and entitled, "CAN END, DOUBLE ACTION TAB THEREFOR, TOOLING ASSEMBLY, AND ASSOCIATED METHOD," which is hereby incorporated herein by reference.

BACKGROUND

1. Field

The disclosed concept relates generally to containers more particularly, to can ends for containers, such as beer and beverage cans. The disclosed concept also relates to a double action tab for can ends. The disclosed concept further relates to tooling assemblies and associated methods for can ends and tabs therefor.

2. Background Information

Metallic containers (e.g., cans) for holding products such as, for example, liquids, beverages, or food products, are typically provided with an easy open can end on which an opening mechanism, such as a pull tab, is attached (e.g., without limitation, riveted) to a tear strip or severable panel. Typically, the tear strip is defined by a scoreline in the exterior surface (e.g., public side) of the can end. The pull tab is structured to be lifted, pulled, and/or rotated to sever the scoreline and deflect the tear strip, thereby creating an opening for dispensing the contents of the can.

When the can end is made, it originates as a can end shell, which is formed from a sheet metal product (e.g., without limitation, sheet aluminum; sheet steel). The shell is then conveyed to a conversion press, which has a number of successive tool stations. As the shell advances from one tool station to the next, conversion operations such as, for example and without limitation, rivet forming, paneling, scoring, embossing, tab securing and tab staking, are performed until the shell is fully converted into the desired can end and is discharged from the press. Typically, each tool station of the conversion press includes an upper tool member, which is structured to be advanced towards a lower tool member upon actuation of a press ram. The shell is received between the upper and lower tool members. Thus, as the upper tool member engages the shell, the upper and/or lower tool members respectively act upon the public and/or product (e.g., interior side, which faces the can body) sides of the shell, in order to perform a number of the aforementioned conversion operations. Upon completion of a given operation, the press ram retracts the upper tool member and the partially converted shell is moved to the next successive tool station, or the tooling is changed within the same station, to perform the next conversion operation.

In the canmaking industry, there is an ongoing desire to improve the rate and manner in which the contents of the container are dispensed. Specifically, the can end design can significantly impact the pour characteristics of the can. For example, interrupted or discontinuous flow often results from the air flow and associated pressure differential between the interior and exterior of the can. As a result, glugging and/or splashing, a slower than desired pour or flow rate, and/or excessive carbonation or foaming of the dispensed liquid, can result. Prior proposals for addressing these issues suffer from various disadvantages. Among them, are complexity of design and/or multiple component pull tabs or opening mechanisms, which are costly and/or impractical to produce, or fail to achieve the desired result. Many known designs also require substantial modification or complete redesign of the can end, for example to change the geometry of the tear strip and associated opening, and/or to add a number of additional tear strips.

There is, therefore, room for improvement in containers, such as beer and beverage cans, and in can ends and tabs therefor, as well as associated tooling assemblies and methods.

SUMMARY

These needs and others are met by embodiments of the disclosed concept, which are directed to a double action tab for can ends and containers, and associated tooling and methods. Among other benefits, the double action tab improves the rate and manner in which the contents of the container are dispensed.

As one aspect of the disclosed concept, a tab is provided for a can end. The can end includes an end panel and a scoreline defining a tear panel in the end panel for providing an opening in the can end. The tab comprises: a body including a first end and a second end disposed opposite and distal from the first end; a nose portion located at or about the first end of the tab; a lift portion located at or about the second end of the tab; a rivet receiving portion disposed proximate the nose portion, the rivet receiving portion including a rivet hole; a first rivet structured to extend outwardly from the end panel and fasten the rivet receiving portion of the tab to the can end; and a second rivet structured to extend outwardly from the end panel to cooperate with a portion of the body proximate the lift portion.

A can end and can employing the aforementioned tab, and associated tooling and method are also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
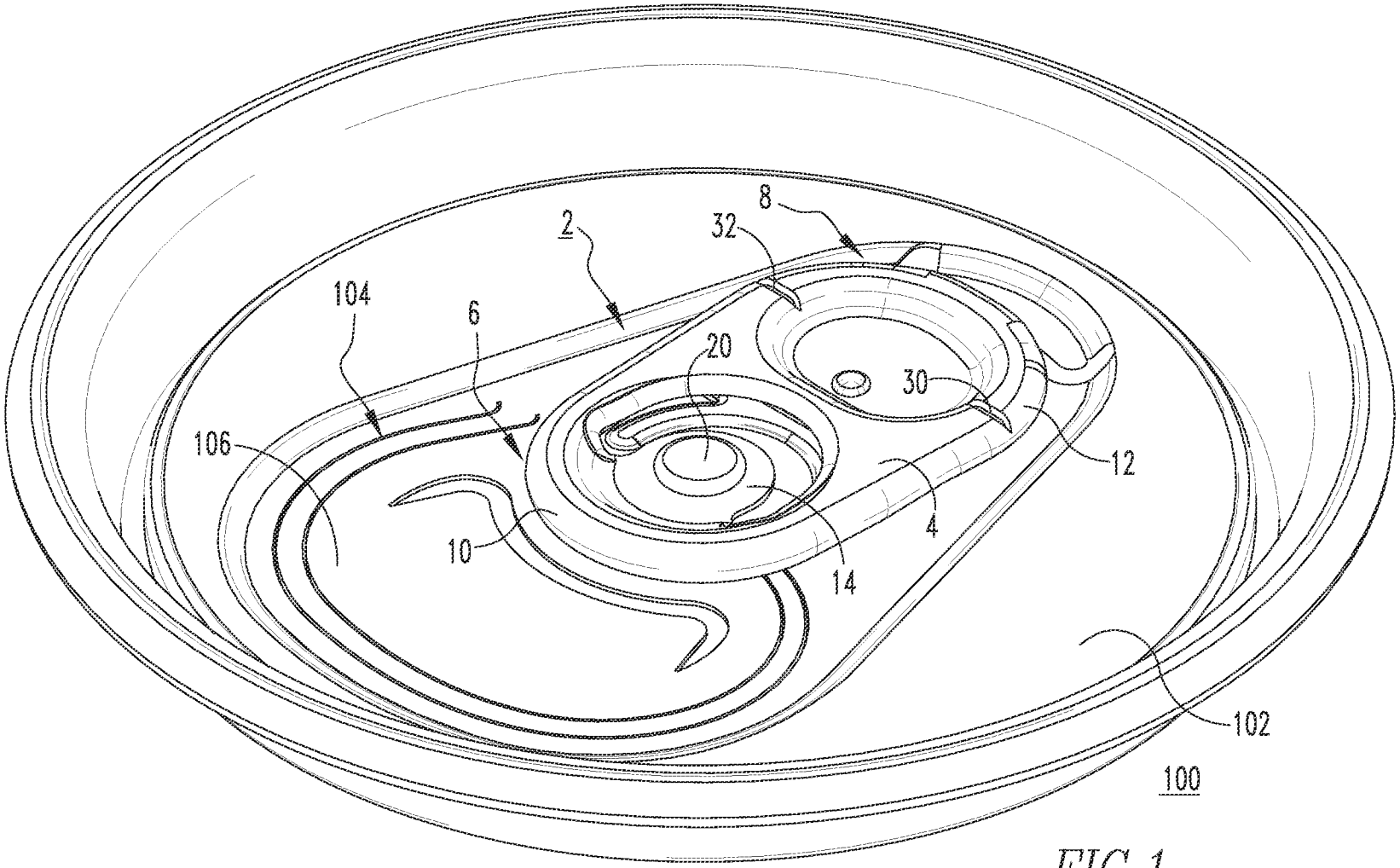
FIG. 1 is an isometric view of a can end and double action tab therefor, in accordance with an embodiment of the disclosed concept.

For purposes of illustration, embodiments of the disclosed concept will be described as applied to can ends for beverage/beer cans, although it will become apparent that they could also be employed to other contains such as, for example and without limitation, cans for liquids other than beer and beverages, and food cans.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, front, back, top, bottom, upper, lower and derivatives thereof, relate to the orientation of the elements shown in the drawings and are not limiting upon the claims unless expressly recited therein.

As employed herein, the terms "can" and "container" are used substantially interchangeably to refer to any known or suitable container, which is structured to contain a substance (e.g., without limitation, liquid; food; any other suitable substance), and expressly includes, but is not limited to, food cans, as well as beverage cans, such as beer and soda cans.

As employed herein, the term "can end" refers to the lid or closure that is structured to be coupled to a can, in order to seal the can.

As employed herein, the term "can end shell" is used substantially interchangeably with the term "can end." The "can end shell" or simply the "shell" is the member that is acted upon and is converted by the disclosed tooling to provide the desired can end.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a tab 2 for a can end 100 in accordance with one non-limiting embodiment of the disclosed concept. Among other features, the can end 100 includes an end panel 102 and a scoreline 104, which defines a tear panel 106. Accordingly, when the tab 2 is actuated (e.g., without limitation, lifted and pivoted or rotated) it will sever the scoreline 102 about the tear panel 106, and depress the tear panel 106 downward, thereby providing an opening in the can end 100 for dispensing the contents of the container or can 200 (partially shown in simplified form in phantom line drawing in FIG. 3) to which the can end 100 is affixed.

Figure 2:
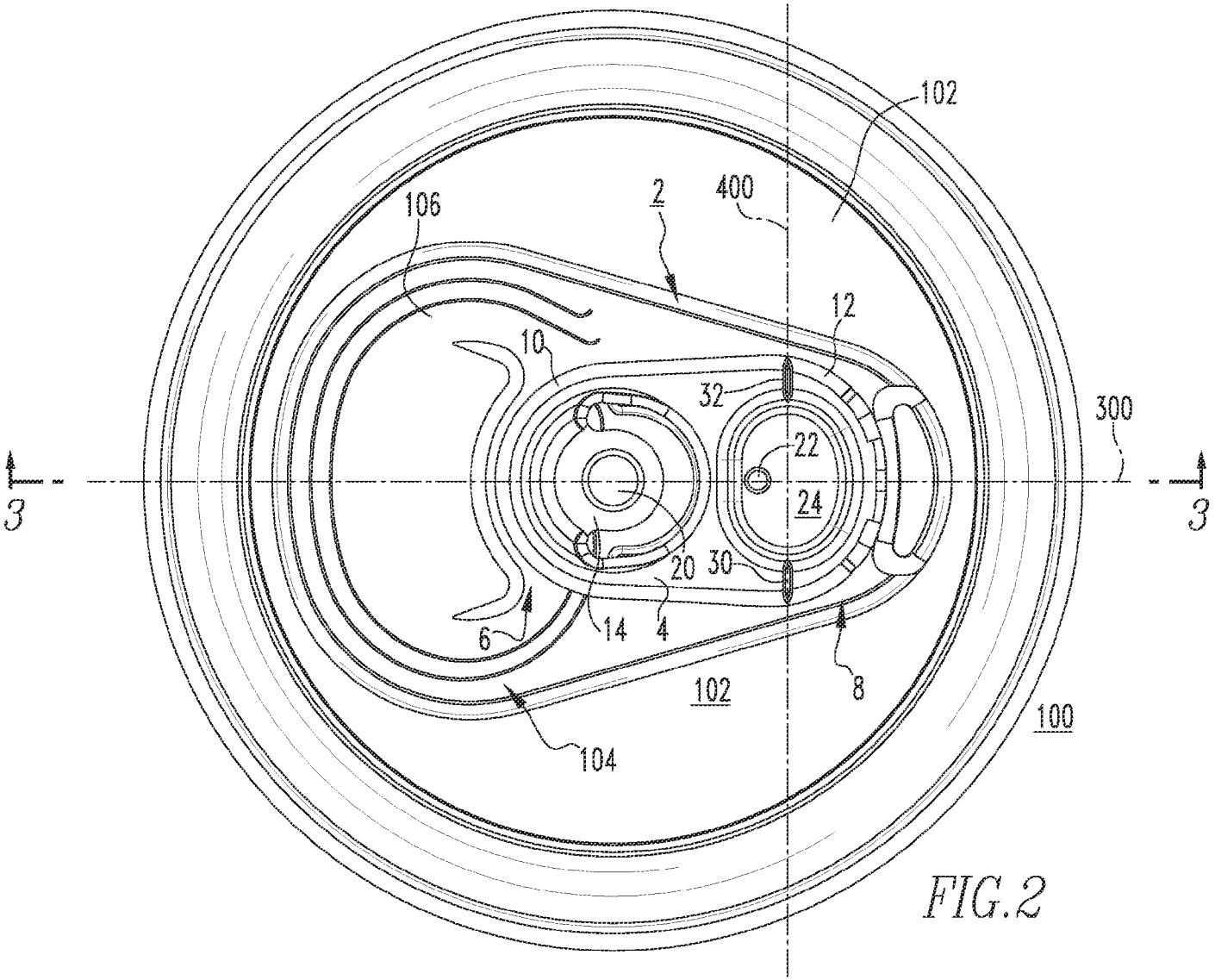
FIG. 2 is a top plan view of the can end and double action tab therefor of FIG. 1.
Figure 3:
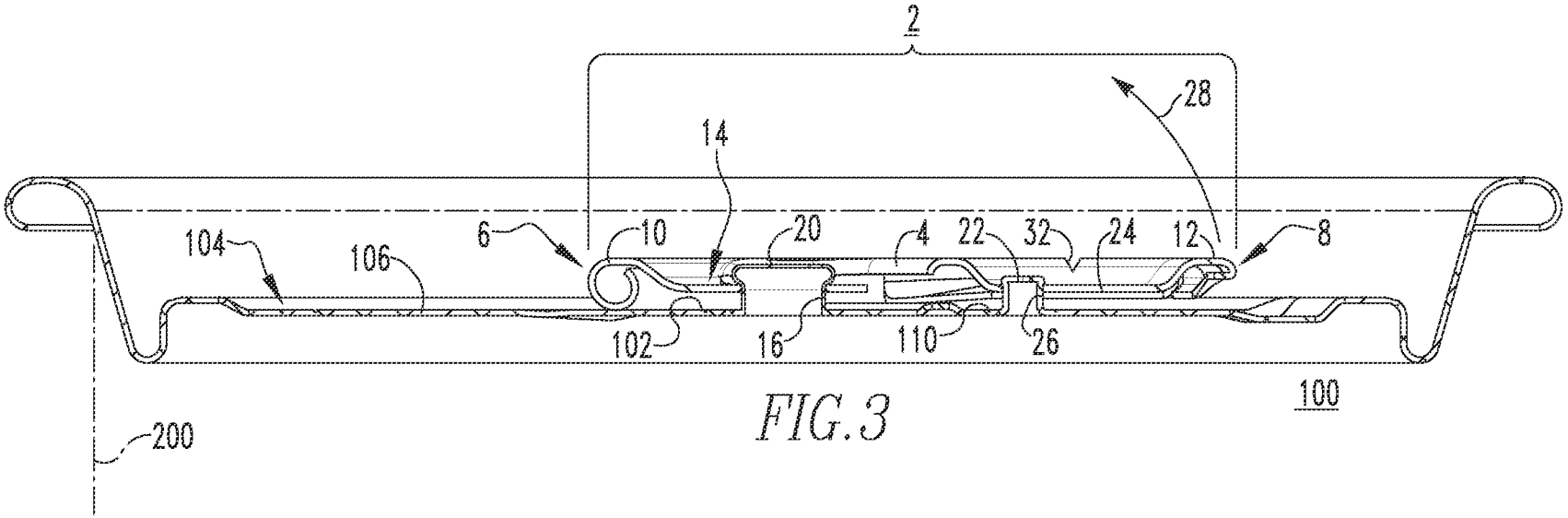
FIG. 3 is a section view taken along line 3-3 of FIG. 2.

Continuing to refer to FIG. 1, and also to FIGS. 2, 3 and 4A-4C, the tab 2 in the example shown and described herein, includes a body 4 having opposing first and second ends 6,8. As shown, a nose portion 10 is located at or about the first end 6 of the tab 2, and a lift portion 12 is located at or about the second end 8 of the tab 2. A rivet receiving portion 14 is disposed proximate the nose portion 10, and includes a rivet hole 16 (FIG. 3). As best shown in the section view of FIG. 3, a first rivet 20 extends outwardly from the end panel 102 and fastens the rivet receiving portion 14 of the tab 2 to the can end 100. A second rivet 22 is structured to extend outwardly from the end panel 102 to cooperate with a portion of the tab body 4 proximate the lift portion 12 of the tab 2.

Figure 4A:
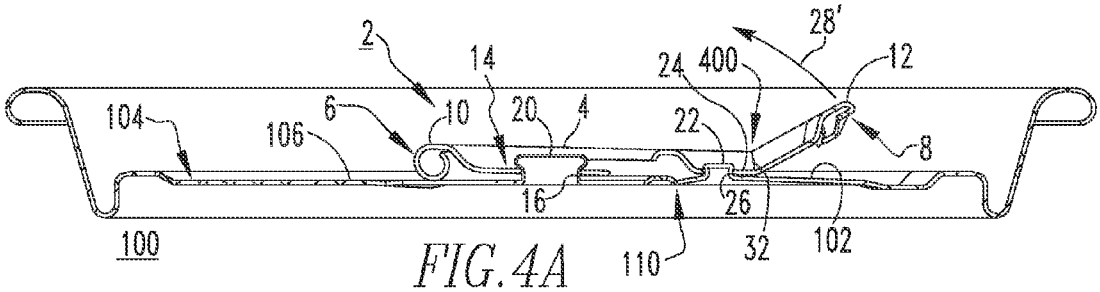
FIGS. 4A, 4B and 4C are side elevation views of the can end and double action tab therefor of FIG. 3, sequentially showing the operation of the tab to open and vent a can end, in accordance with an embodiment of the disclosed concept.
Figure 4B:
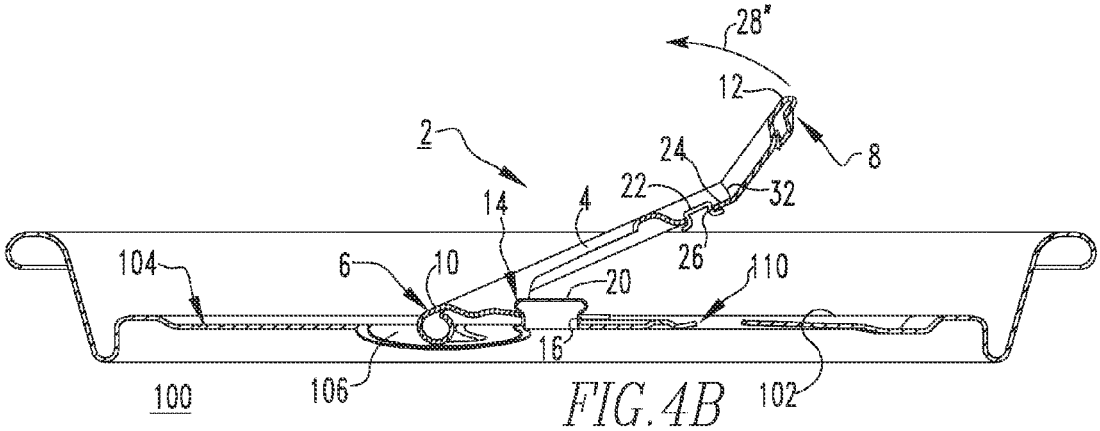
Figure 4C:
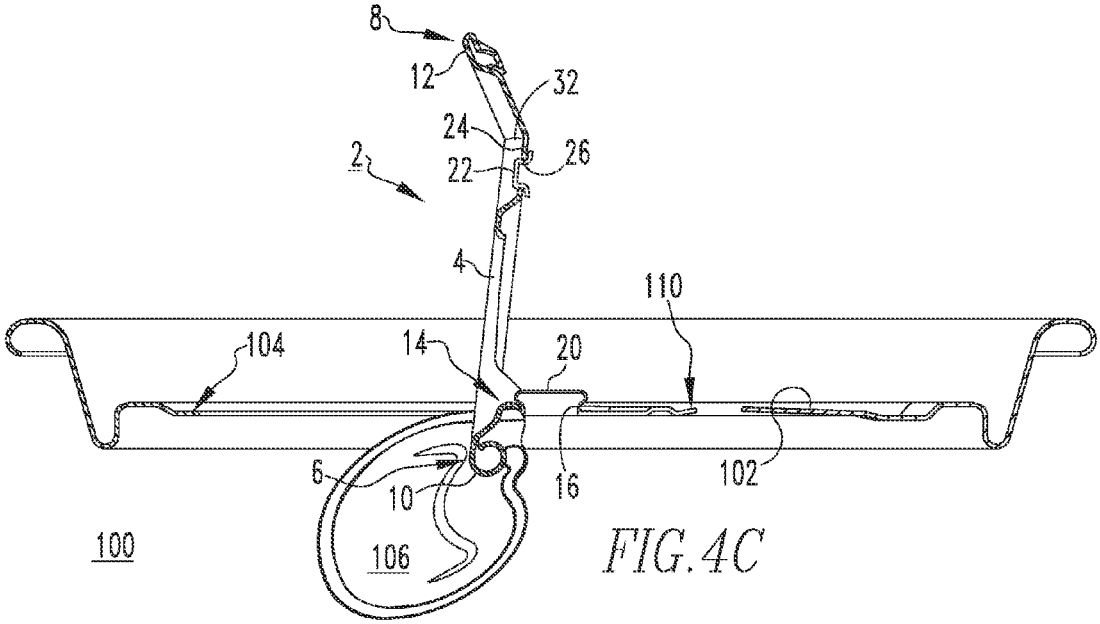
Figure 5A:
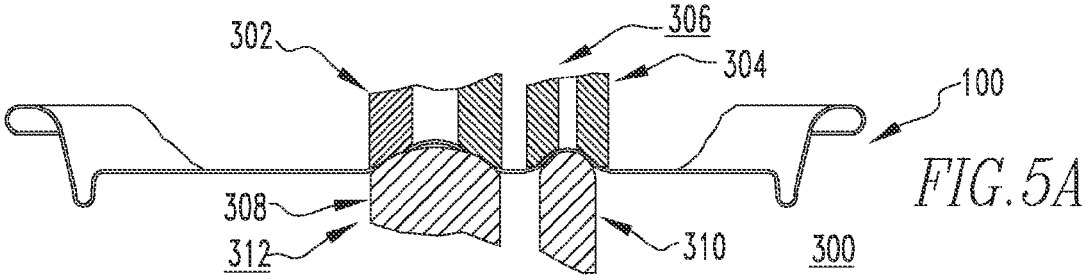
FIGS. 5A-5E are side elevation section views showing a portion of tooling performing a sequential forming operation, in accordance with an embodiment of the disclosed concept.
Figure 5B:
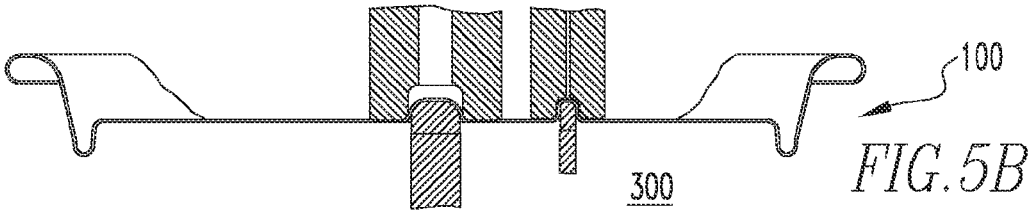
Figure 5C:
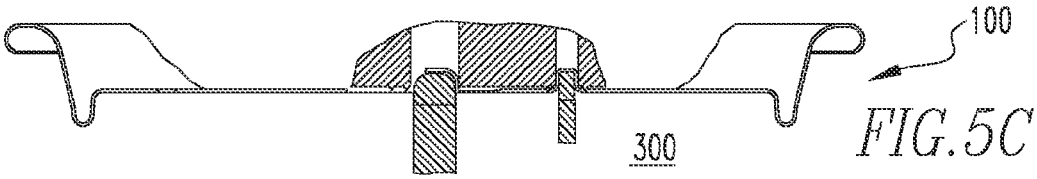
Figure 5D:
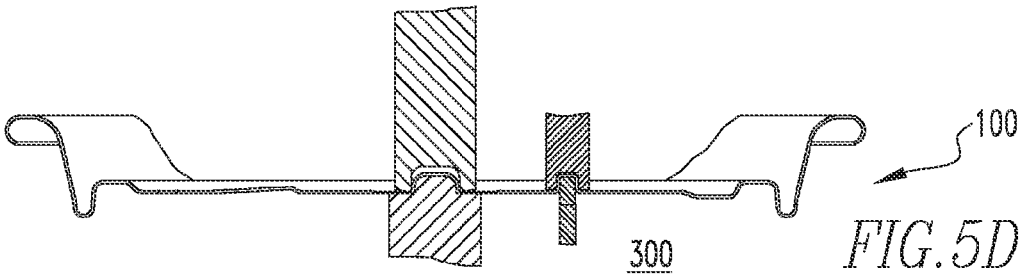
Figure 5E:
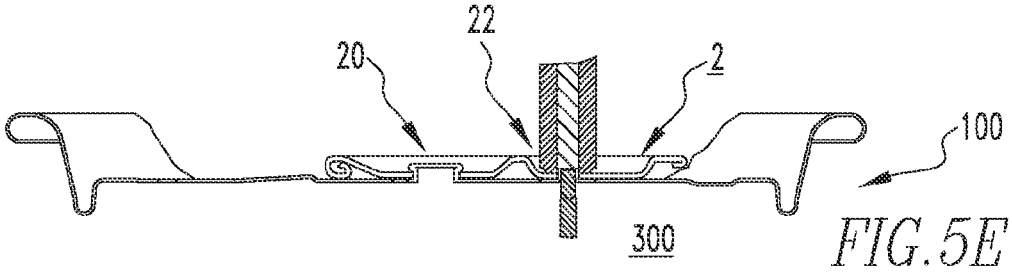
Figure 6A:
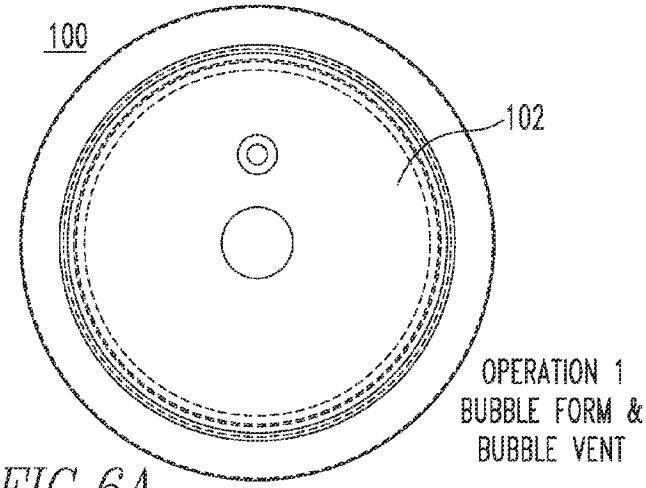
FIGS. 6A-6H are top plan views showing the sequential for forming a vented can end, in accordance with an embodiment of the disclosed concept.
Figure 6B:
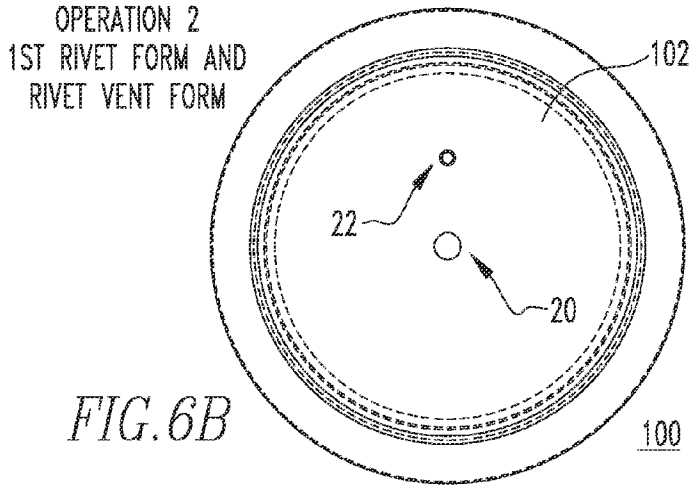
Figure 6C:
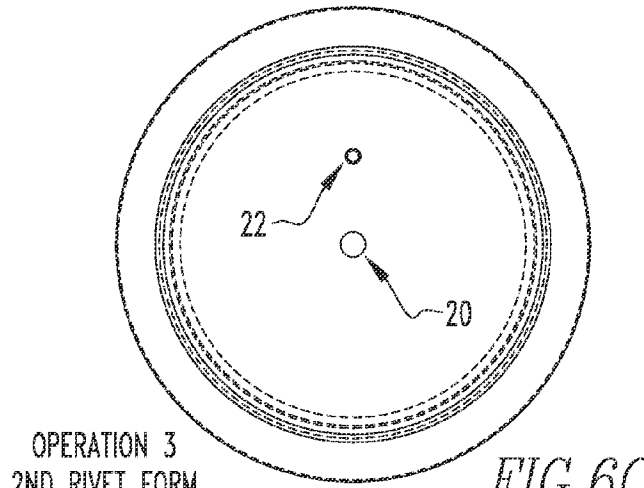
Figure 6D:
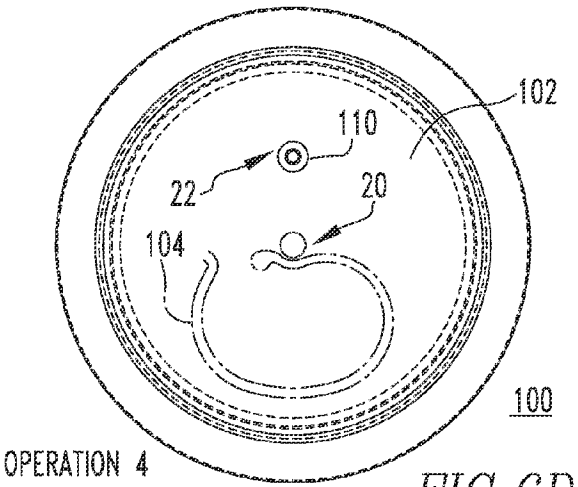
Figure 6E:
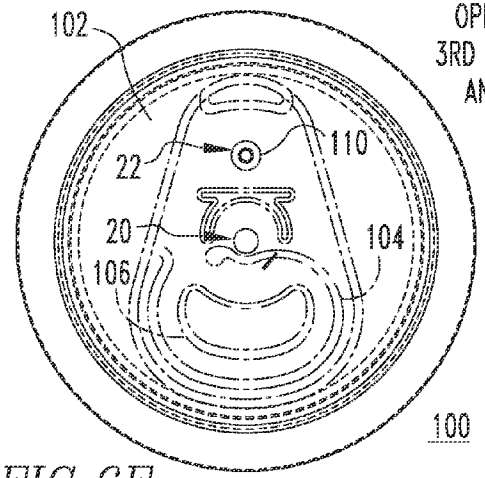
Figure 6F:
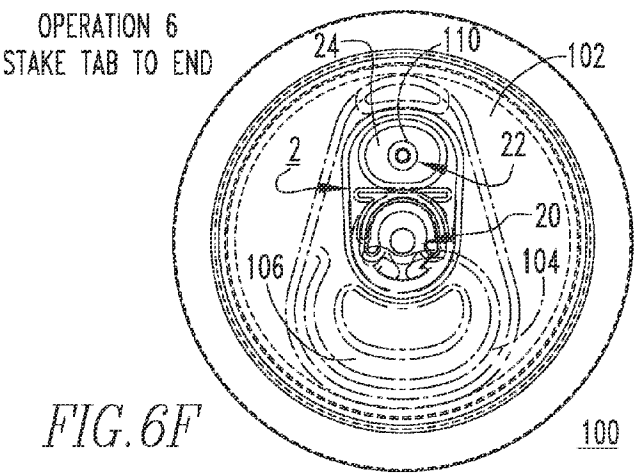
Figure 6G:
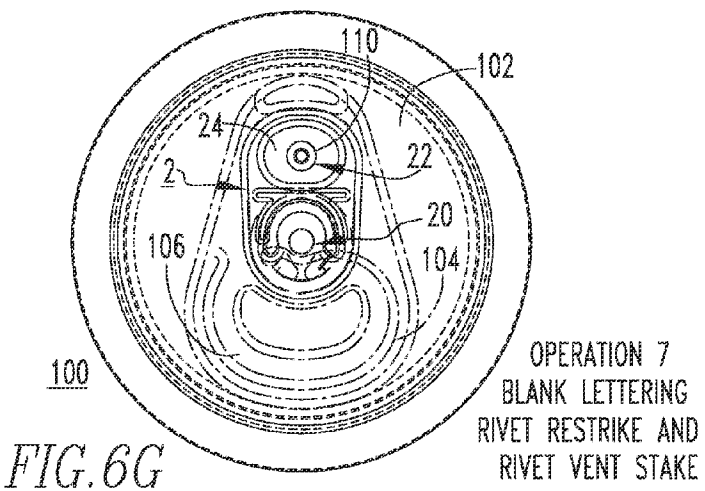
Figure 6H:
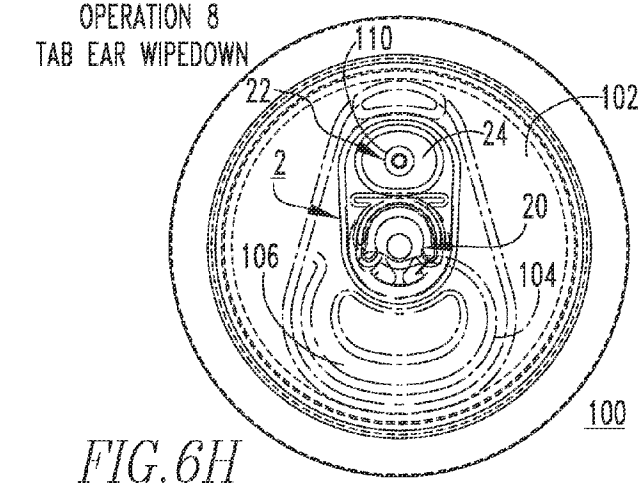

More specifically, the body 4 of the tab 2 preferably further includes a recessed panel 24. The recessed panel 24 includes a rivet aperture 26 (FIGS. 3 and 4A-4C). The second rivet 22 extends through the rivet aperture 26 and is fastened (e.g., without limitation, staked) to the recessed panel 24 of the tab body 4, as best shown in FIG. 3. Accordingly, when the lift portion 12 is lifted (e.g., pivoted counterclockwise in the direction of arrow 28 of FIG. 3), the lift portion 12 of the tab 2 and, in particular, the recessed panel 24, is structured to detach the second rivet 22 from the end panel 102, thereby creating a vent opening (FIGS. 4B and 4C) in the can end 100. Further rotation of the tab 2 severs the scoreline 104 and opens the tear panel 106 to create the dispensing opening (FIGS. 4B and 4C) in the can end 100, in a generally well known manner. Operation of the tab 2 will be further appreciated with reference to the sequential steps for opening and venting the can end 100, which are shown in FIGS. 4A, 4B and 4C.

Accordingly, it will be appreciated that the vent opening (FIGS. 4B and 4C) created by the removal (e.g., without limitation, detachment) of the second rivet 22 from the end panel 102 provides the necessary ventilation to regulate (e.g., without limitation, equalize) the air pressure between the interior of the container (see, for example and without limitation, can 200 partially shown in simplified form in phantom line drawing in FIG. 3) and the exterior of the container 200 (FIG. 3). Consequently, disadvantages (e.g., without limitation, glugging; slow pour rate; intermittent pouring; splashing; excessive carbonation and foaming) of prior art designs are substantially addressed and overcome, and the pour characteristics of the can end 100 are improved.

It will further be appreciated that the end panel 102 of the can end 100 may further include an additional scoreline 110, for example extending circumferentially around the base of the second rivet 22, as shown in FIGS. 3 and 4A-4C. Such scoreline 110 further facilitates detachment and separation of the second rivet 22 from the end panel 102 and creation of the associated vent opening (see, for example, FIGS. 4B and 4C) upon actuation of the tab lift portion 12, as shown in the sequential steps of FIGS. 4A, 4B and 4C. FIG. 4A illustrates an optional additional opening step discussed in greater detail hereinbelow.

The disclosed tab 2 can, therefore, be characterized as a "double-action tab." That is, in a first action, namely lifting the lift portion 12 and pivoting (e.g., rotating counterclockwise in the direction of arrow 28' from the perspective of FIG. 4A) the tab body 4 as shown in FIGS. 4A and 4B, the tab 2 detaches the second rivet 22, as shown in FIG. 4B, as previously described hereinabove. In a second action, namely continued pivoting (e.g., rotation counterclockwise in the direction of arrow 28" from the perspective of FIG. 4B) of the tab body 4 to the ending position of FIG. 4C, the nose portion 10 of the tab 2 severs the scoreline 104 and opens the tear panel 106, as sequentially shown in FIGS. 4B and 4C.

Among other benefits, the tab 2 preferably comprises a single unitary piece of material as opposed to requiring a plurality of relatively complex components or pieces in accordance with known designs. The tab 2 also functions in a unique and relatively simple manner that essentially requires only one single continuous motion (see, for example, FIGS. 4A-4C) of the tab 2, as opposed to requiring the user to perform a number of different steps and/or movements of a plurality of different components in order to create a vent opening and open the can end. Specifically, the user merely needs to lift the lift portion 12 of the tab 2 and pivot it (e.g., without limitation, rotate counterclockwise in the direction of arrows 28, 28' and 28" from the perspectives of FIGS. 3, 4A and 4B, respectively) in the traditional, well known manner, in order to effectuate the aforementioned severance or detachment of the second rivet 22 (FIG. 4B), as well as opening the tear panel 106 (FIG. 4C).

It will be appreciated that the tab 2 may or may, but need not necessarily, include a number of additional features such as, for example and without limitation, a plurality of slots 30,32.

More specifically, a longitudinal axis 300 extends through the center of the tab 2 between the first and second ends 6,8 thereof, as best shown in FIG. 2. The slots 30,32 in the non-limiting example embodiment shown and described herein are disposed between the nose portion 10 and the lift portion 12 of the tab 2, on opposing sides of the tab body 4. The slots 30,32, therefore, combine to form a fulcrum 400 that extends generally transverse to the longitudinal axis 300, as shown in FIG. 2. The fulcrum 400 enables the lift portion 12 to pivot upwards (see, for example, FIG. 4A) and downwards (not shown) in relation to the nose portion 10 of the tab 2. This can make it easier, for example, for the user to initially lift the lift portion 12 of the tab 2, as shown in FIG. 4A, due to the enhanced flexibility of the tab 2 resulting from the slots 30,32 (only one slot 32 is shown in the sectional views of FIGS. 3-4C).

A tooling assembly for providing the tab 2 generally includes a number of tooling stations each including a first tool member and a second tool member disposed opposite the first tool member. The first and second tool members are structured to cooperate in order to form the tab 2 having the aforementioned features. It will also be appreciated that a number of tooling stations and tool members therefor are employed within a conversion press to convert shells into finished can ends 100 having the disclosed tab 2 affixed thereto, and being ready to be affixed (e.g., without limitation, seamed) to a corresponding containers (e.g., without limitation, can bodies (see, for example, can 200 partially shown in simplified form in phantom line drawing in FIG. 3)). By way of one non-limiting example, FIGS. 5A-5E show tooling 300 and corresponding forming operations, wherein tool members (see, for example and without limitation, first tool members 302,304 of upper tooling assembly 306 and second tool members 208,310 of lower tooling assembly 312 of FIG. 5A) act on a shell to form rivets 20,22 of a can end 100.

A method for providing a vented can end 100 and double action tab 2 therefor, in accordance with the disclosed concept, involves the steps of forming first and second rivets 20,22 on the end panel 102 of the can end 100 using the aforementioned tooling assembly. The sequential forming steps in accordance with one non-limiting example embodiment of the disclosed concept are shown in FIGS. 6A-6H.

In operation, when the lift portion 12 of the tab 2 is actuated (e.g., rotated counterclockwise in the direction of arrow 28 from the perspective of FIG. 3) the tab 2 detaches the second rivet 22 from the end panel 102 of the can end 100 to create the vent opening in the can end 100, thereby enhancing the pour characteristics of the can end 100 as described hereinabove.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A tab for a can end, the can end comprising an end panel, a first rivet, a second rivet, and a scoreline defining a tear panel in the end panel for providing an opening in the can end, the tab comprising:

a body including a first end, a second end disposed opposite and distal from the first end, and a top surface disposed in a first plane;

a nose portion located at or about the first end of the tab;

a lift portion located at or about the second end of the tab, the lift portion being structured to pivot about the second rivet;

a rivet receiving portion disposed proximate the nose portion, the rivet receiving portion including a rivet hole;

a recessed panel located proximate the lift portion and being disposed in a second plane parallel to the first plane, the recessed panel including a rivet aperture, the second rivet being structured to extend through the rivet aperture and be fastened to the recessed panel; and a middle portion separating the recessed panel from the rivet receiving portion;

wherein the first rivet is structured to extend outwardly from the end panel and fasten the rivet receiving portion of the tab to the can end;

wherein the second rivet is structured to extend outwardly from the end panel;

wherein when the lift portion is lifted, the second plane of said recessed panel remains parallel to the first plane of the top surface of the body;

wherein the recessed panel extends from proximate the second end toward the rivet receiving portion;

wherein the second rivet is structured to be disposed in the recessed panel;

wherein the middle portion comprises a top portion, a first downwardly extending portion, and a second downwardly extending portion;

wherein the top portion is generally coplanar with the top surface of the tab body;

wherein the first downwardly extending portion extends from the top portion to the recessed panel; and wherein the second downwardly extending portion extends from the top portion toward the rivet receiving portion.

2. The tab of claim 1 wherein the end panel further comprises an additional scoreline proximate the second rivet; and wherein when the lift portion pivots about the second rivet, the additional scoreline at least partially severs to vent the can end.

3. The tab of claim 2 wherein the additional scoreline extends circumferentially around the second rivet.

4. The tab of claim 3 wherein, when the lift portion is lifted, the lift portion is structured to detach the second rivet from the end panel, thereby creating a vent opening in the can end.

5. The tab of claim 1 wherein the body further comprises a longitudinal axis extending through the center of the tab between the first end and the second end, and a plurality of slots; wherein the slots are disposed between the nose portion and the lift portion on opposing sides of the tab; wherein the slots combine to form a fulcrum that extends generally transverse to the longitudinal axis; and wherein the fulcrum enables the lift portion to pivot upwards and downwards in relation to the nose portion.

6. The tab of claim 1 wherein the tab comprises a single unitary piece of metal.

7. A combination of a tab with a can end affixed to the tab, the can end being selected from the group consisting of beer can ends, beverage can ends and food can ends, the can end comprising an end panel, a first rivet, a second rivet, and a scoreline defining a tear panel in the end panel for providing an opening in the can end, the tab comprising:

a body including a first end, a second end disposed opposite and distal from the first end, and a top surface disposed in a first plane;

a nose portion located at or about the first end of the tab;

a lift portion located at or about the second end of the tab, the lift portion being structured to pivot about the second rivet;

a rivet receiving portion disposed proximate the nose portion, the rivet receiving portion including a rivet hole;

a recessed panel located proximate the lift portion and being disposed in a second plane parallel to the first plane, the recessed panel including a rivet aperture, the second rivet being structured to extend through the rivet aperture and be fastened to the recessed panel; and a middle portion separating the recessed panel from the rivet receiving portion;

wherein the first rivet is structured to extend outwardly from the end panel and fasten the rivet receiving portion of the tab to the can end;

wherein the second rivet is structured to extend outwardly from the end panel;

wherein when the lift portion is lifted, the second plane of said recessed panel remains parallel to the first plane of the top surface of the body;

wherein the recessed panel extends from proximate the second end toward the rivet receiving portion;

wherein the second rivet is structured to be disposed in the recessed panel;

wherein the middle portion comprises a top portion, a first downwardly extending portion, and a second downwardly extending portion;

wherein the top portion is generally coplanar with the top surface of the tab body;

wherein the first downwardly extending portion extends from the top portion to the recessed panel; and wherein the second downwardly extending portion extends from the top portion toward the rivet receiving portion.

8. The tab of claim 1 wherein the lift portion has a top surface disposed in a third plane; and wherein before the lift portion is lifted, the third plane is coplanar with the first plane.

9. The tab of claim 1 wherein a portion of the nose portion and a portion of the lift portion have curled edges.

10. The tab of claim 5 wherein each of the plurality of slots is disposed between the second rivet and the second end; and wherein the fulcrum is spaced from the second rivet.

11. The tab of claim 10 wherein the opposing sides comprise a first side and a second side opposite the first side, wherein the plurality of slots comprises a first slot disposed on the first side and a second slot disposed on the second side, and wherein the recessed panel extends from proximate the first slot to proximate the second slot.

12. The tab of claim 1 wherein the body is devoid of a finger hole.

13. The combination of claim 7 wherein the can end further comprises an additional scoreline in the end panel, and wherein the additional scoreline extends circumferentially around the second rivet.

14. The combination of claim 7 wherein when the lift portion is lifted, the tear panel is structured to remain attached to the end panel.

15. The combination of claim 7 wherein the entire tear panel is substantially disposed on a first side of the end panel.

* * * * *

UNITED STATES PATENT AND TRADEMARK OFFICE

CERTIFICATE OF CORRECTION

PATENT NO. : 9,016,504 B2
APPLICATION NO. : 13/554438
DATED : April 28, 2015
INVENTOR(S) : McClung et al.

It is certified that error appears in the above-identified patent and that said Letters Patent is hereby corrected as shown below:

In the specification

Column 1, line 16, delete “containers more” and insert --containers, more--.
Column 3, line 1, delete “contains” and insert --containers--.
Column 5, line 27, delete “containers” and insert --container--.
Column 5, line 34, delete “208,310” and insert --308,310--.

Signed and Sealed this
Fifth Day of January, 2016

Michelle K. Lee

Michelle K. Lee
*Director of the United States Patent and Trademark Office*